US005170141A

United States Patent [19]

Yamazaki et al.

[11] Patent Number: 5,170,141

[45] Date of Patent: Dec. 8, 1992

[54] CERAMIC FILTER

[75] Inventors: Kazuhisa Yamazaki, Hamamatsu; Junji Konda, Aichi; Shigemitsu Suzuki, Hamamatsu, all of Japan

[73] Assignee: Fuji Electrochemical Co., Ltd., Tokyo, Japan

[21] Appl. No.: 785,009

[22] Filed: Oct. 30, 1991

[30] Foreign Application Priority Data

Nov. 5, 1990 [JP] Japan ..... 2-299572
Nov. 30, 1990 [JP] Japan ..... 2-334178
Jun. 7, 1991 [JP] Japan ..... 3-163866

[51] Int. Cl.[5] ..... H01P 1/205

[52] U.S. Cl. ..... 333/202; 333/203; 333/206; 333/207; 333/222

[58] Field of Search ..... 333/202, 202 DB, 203, 333/206, 207, 208-212, 219, 222, 223, 106, 245, 202 DR, 202 H

[56] References Cited

U.S. PATENT DOCUMENTS 4,740,765 4/1988 Ishikawa et al. ..... 333/202 X
4,800,347 1/1989 Yorita et al. ..... 333/202

FOREIGN PATENT DOCUMENTS 63-64404 3/1988 Japan .

*Primary Examiner*—Eugene R. LaRoche
*Assistant Examiner*—Ali Neyzari
*Attorney, Agent, or Firm*—Keck, Mahin & Cate

[57] ABSTRACT

A dielectric resonator block has at least three resonators and coupling device for coupling the adjacent resonators. A reactance element is added in parallel to the coupling device to provide an attenuation pole. A capacitor block of a dielectric material is provided which has through-holes to form hole electrodes and a surface electrode so that two coupling capacitances are provided. One of the two coupling capacitances serves as the reactance element. One of the hole electrodes of the capacitor block is connected with an external connector, and the other hole electrodes are connected with the resonators.

6 Claims, 5 Drawing Sheets

CERAMIC FILTER

BACKGROUND OF THE INVENTION

The present invention relates in general to radio frequency (RF) signal filters, and more particularly to an improved ceramic bandpass or band-elimination filter that is particularly well adapted for use in radio transmitting and receiving circuitry. Further, the present invention provides dielectric multi-resonator filters including a plurality of resonators that are quarter-wavelength coaxial transimission lines. The present invention is best applicable to a bandpass filter in which adjacent resonators are coupled by a coupling means and a capacitive reactance element is provided in parallel to the coupling means to provide an attenuation pole or poles.

A conventional multi-resonator filter in a unitary structure of a single dielectric block is shown in Japanese Patent Publication (unexamined) No. 63-64404 published Mar. 22, 1988, in which a plurality of resonators are formed in a dielectric block. A coupling device for coupling the adjacent resonators and a reactance element, in parallel to the coupling device, are provided for forming an attenuation pole, so that greater attenuation out of the band is obtained without increasing the number of resonators.

In the conventional dielectric filter disclosed in the above-stated Japanese publication, the filter includes a block which is comprised of a dielectric material that is selectively plated with a conductive material. The dielectric block has four resonator holes, which each extend from the top surface to the bottom surface thereof. The resonator holes are likewise plated with an electrically conductive material to provide an inner conductor. The dielectric block has coupling holes between the adjacent resonator holes. The dielectric block is covered or plated with a conductive material with the exception of one side where the resonator holes are opened to thereby form an outer conductor so that the inner conductor and the outer conductor are short-circuited by a metalized layer on one side of the dielectric block. A resonator is formed by the inner conductor, outer conductor and a dielectric block portion between the inner and outer conductors.

Resin molded terminals are fitted to the resonator holes, the resin molded terminals being formed of metal pins with resin enclosed therearound. A predetermined electrostatic capacitance is formed between the metal pins and respective inner conductor, and the metal pins are connected to each other by a substrate having a conductive pattern. One resin molded terminal constitutes a coupling capacitance and the other resin molded terminal constitutes a capacitive reactance element. By addition of the coupling capacitance, an attenuation pole is formed to thereby increase the amount of attenuation of frequency out of the band.

Basically, a value of a coupling reactance for providing an attenuation pole is generally very small, for example 1 pF or less, and a very small variation or change in the coupling reactance results in changes in filter characteristics. Accordingly, in the conventional filter structure as disclosed in the aforementioned Japanese publication wherein the resin molded terminals are reactance elements, there are numbers of variation factors such as shape or diameter of the resonator holes, fitting dimensions of the resin, etc. and there is an inconvenience in adjusting the coupling.

SUMMARY OF THE INVENTION

An object of the present invention is to provide an improved ceramic filter that has less variation factors for facilitating adjustment.

Another object of the present invention is to provide an improved ceramic filter that is smaller and has fewer parts than prior art filters, without any sacrifice in operational properties.

According to the present invention, there is provided a ceramic filter comprising:

a dielectric resonator block having at least three resonators in an integral form, coupling means for coupling said resonators, a dielectric capacitor block having a plurality of holes, a first electrode means on a part of the outer surface of said capacitor block, and a second electrode means disposed on said holes of the capacitor block, a first capacitor portion for obtaining a coupling capacitance in combination with one of said resonators, a second capacitor portion connected in parallel with said coupling means for serving as a reactance element, and common electrode means for the first and second capacitor portions, said common electrode means being connected with external connectors.

In an embodiment of the invention, the dielectric capacitor block has a first hole with an electrode therein, a second hole with an electrode therein and a surface electrode means on an upper or side surfaces of the capacitor block. In this structure, the first hole electrode is connected to the external connector, and both the second electrode and the surface elecrode are connected to the electrode of the resonator.

In the present invention, a simple capacitor block of a dielectric material has two capacitor portions, in which one is coupling capacitance for one resonator and the other is a capacitive reactance for provision of an attenuation pole, that is, electromagnetic pole of attenuation.

PREFERRED EMBODIMENT OF THE INVENTION

Figure 1:
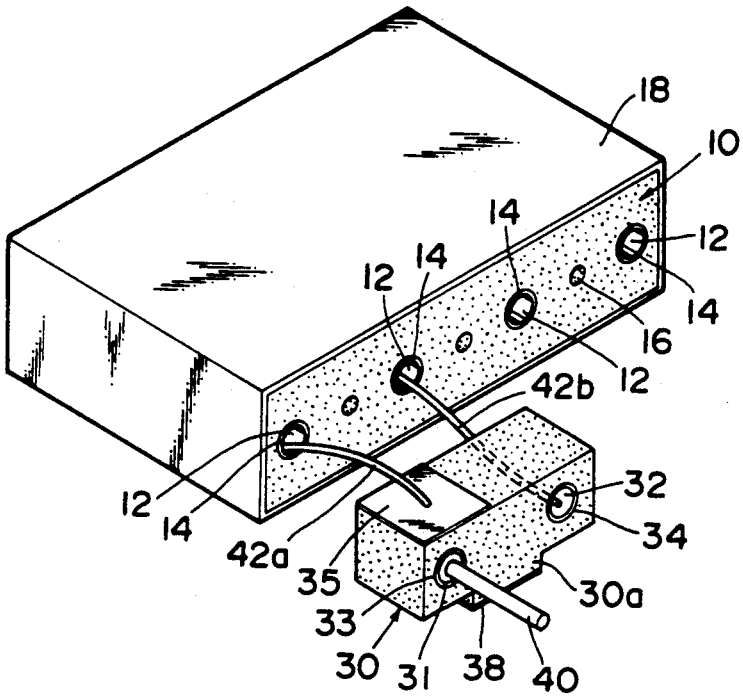
FIG. 1 is a perspective view of a dielectric filter embodying the invention.

Referring first to FIG. 1, a rectangular dielectric block for a resonator unit 10 has a plurality of resonator holes (four holes in the illustrated embodiment) 12 plated with a conductive material to form inner conductors 14, and a coupling hole 16 between the adjacent resonator holes 12. The dielectric block 10 is covered with a conductive material on its four surfaces to form an outer conductor 18. The inner conductor 14 and the outer conductor 18 are short-circuited by a conductive layer on one surface, not shown, of the dielectric block 10. A resonator is formed by the inner and outer conductors 14, 18 and the dielectric material between the inner and outer conductors.

A dielectric block 30 for a capacitor unit, hereinafter referred to as a dielectric capacitor block or simply capacitor block, is provided separately from the dielectric block 10 for resonator. The capacitor block 30 is rectangular parallelopiped with a projection 30*a* at its bottom, and has through-holes 31 and 32. These through-holes 31, 32 are relatively distal to, and spaced from, the location of the projection 30*a*, and plated with a conductive material on the inner surface to form first electrode 33 and second electrode 34. The capacitor block 30 has a surface electrode 35 on the upper surface thereof adjacent the first electrode 33 of the through-hole 31. The projection 30*a* has a conductive film 38 coated on the projected bottom surface. An external connector 40 is inserted into the through-hole 31 to be connected with the first electrode 33. The surface electrode 35 is connected with one electrode 14 of the resonator unit 10 by means of a conductor 42*a* and the second electrode 34 is connected with another electrode 14 by means of a conductor 42*b*. The conductors 42*a*, 42*b* are comprised of a base wire having a small thermal coefficient of expansion, such as Kovar (tradename of Westing House Electric Corp, U.S.A.), with copper or silver coated thereon for improvement in conductivity.

Figure 2:
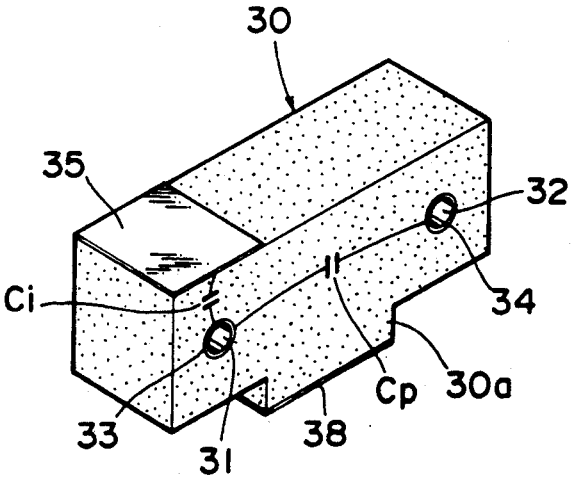
FIG. 2 is a perspective view of a capacitor unit used for the dielectric filter shown in FIG. 1.

As shown in FIG. 2, a coupling capacitance $C_i$ is formed between the first electrode 33 and the confronting, surface electrode 35, and a coupling capacitance Cp is formed between the first electrode 33 and the second electrode 34 so that the coupling capacitance Cp serves as a reactance element. It is sufficient that the coupling capacitance Cp is as small as 1 pF and, accordingly, a coupling capacitance Cp can be obtained sufficiently when the holes 31, 32 for electrodes 33, 34 are spaced apart from each other as illustrated.

Figure 3:
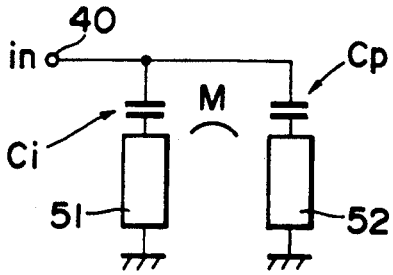
FIG. 3 is an equivalent circuit diagram for two resonators of the dielectric filter shown in FIG. 1.
Figure 4:
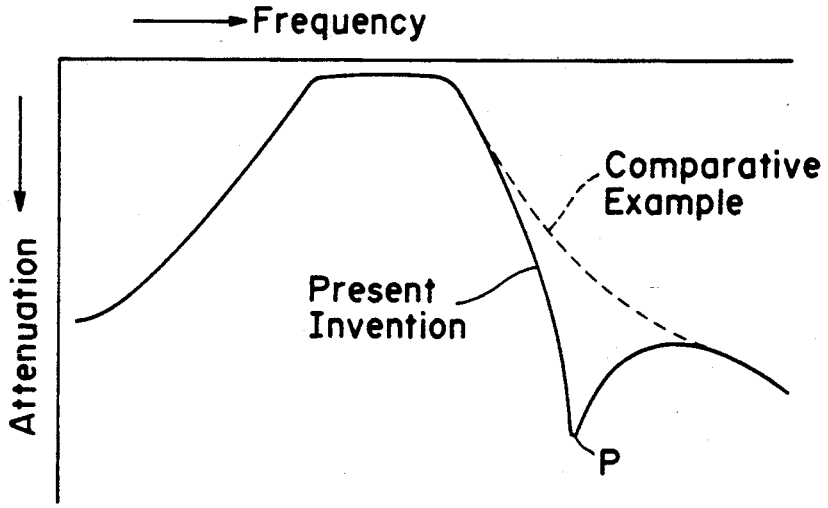
FIG. 4 is a diagram showing filter characteristics obtained by the dielectric filter shown in FIG. 1.

FIG. 3 shows an equivalent circuit of the resonators 51 and 52 in the embodiment of FIGS. 1 and 2. The coupling capacitance Cp is added in parallel to a coupling device M between the resonators and, accordingly, the filter characteristics obtained by the invention provides an attenuation pole by the existence of an attenuation bottom or a rapid trough of the attenuation curve An example of the filter characteristic is shown in FIG. 4, in which an attenuation pole P is formed in a high frequency range. In the illustration of FIG. 4, a dotted line shows an example in which there is no coupling capacitance produced by a reactance element for the attenuation pole.

Although not shown, the dielectric resonator unit 10 and the capacitor unit 30 are mounted in position within a casing, and fixed in position by soldering or any other suitable method.

The projection 30*a* produced on the bottom of the dielectric capacitor block 30 serves to lengthen the distance between the resonators 33, 34 of the holes 31, 32 and the casing (not shown) to thereby minimize the grounding capacitance.

In the construction that the capacitor block 30 is separately prepared and electrically connected with the dielectric resonator block 10 by means of conductive wires as described, the coupling capacitance $C_i$ can be adjusted by cutting out or partly removing the surface electrode 35 or otherwise the first electrode 33 of the hole 31, and similarly, the coupling capacitance Cp can be adjusted by cutting out a portion of the first or second electrode 33, 34 or a dielectric portion between the holes 31 and 32.

Figure 5:
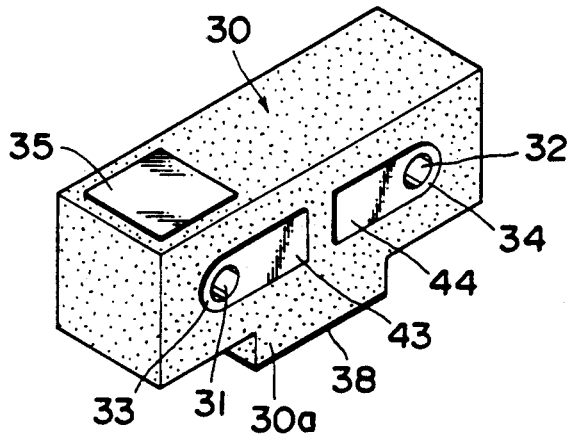
FIG. 5 is a perspective view of a capacitor unit according to another embodiment of the invention.

In FIG. 5 which shows a capacitor unit 30 according to another embodiment of the invention, the conductive patterns 43, 44 of the electrodes 33, 34, respectively, are extended in a confronting relation, with a small gap therebetween, on a side surface of the capacitor unit 30 so that a capacitance can be increased and, if necessary, it can be adjusted by simply cutting out a portion of the patterns If desired, the surface electrode 35 on the top surface of the dielectric block can be disposed on the other surface or side of the block.

The reactance element as described above can be fitted to either input side as shown in FIG. 3 or output side and, if necessary, both the input side and the output side can be provided with reactance elements. By providing the reactance elements to both input and output sides, two attenuation poles as the pole P in FIG. 4 can be obtained. Further, additional reactance element or elements can be connected to the other resonators instead of the input and output side resonators.

According to the present invention, the capacitor unit 30 provides a coupling capacitor and a capacitor serving as a capacitive reactance element. Accordingly, a capacitance is determined by the shape of the dielectric block for the capacitor unit 30 and the electrode patterns, such as patterns 43, 44, disposed thereon. The capacitor unit is formed by a molding die accurately and the electrode patterns are formed by the known pattern printing technique and, therefore, there is less variable factors in the formation of the capacitor block and the patterned electrodes. Thus, a desired small coupling capacitance can be achieved in accuracy. Further, adjustment in capacitance can be readily performed by merely cutting out a portion of the surface electrode and plated electrode in the holes.

FIGS. 6 through 11 show another aspect of the present invention, in which two surfaces of the capacitor unit parallel to the through-hole are covered with a conductive material. A coupling capacitance and a grounding capacitance are formed between the electrode in the hole and either one of the two conductive films on the opposite surfaces of the capacitor unit block.

Figure 6:
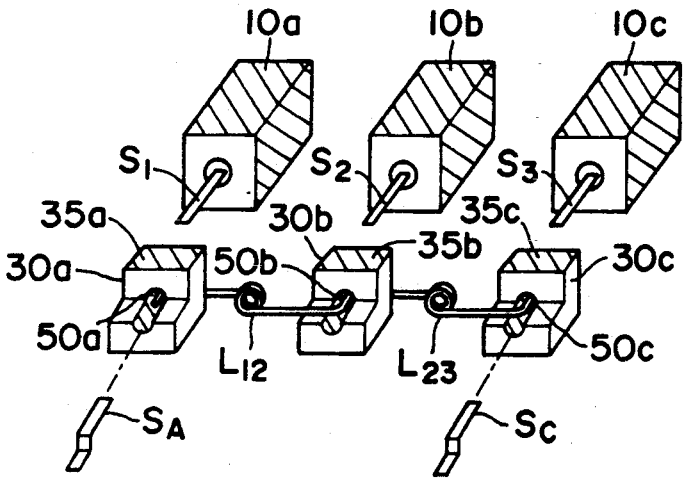
FIG. 6 is a fragmentary perspective view of the dielectric filter according to another embodiment of the invention.
Figure 7:
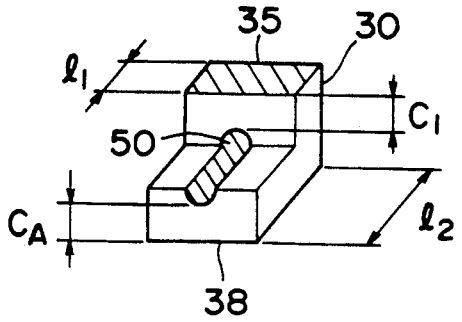
FIGS. 7, 7A and 8 are perspective views of a dielectric block for a capacitor unit of the filter in other embodiments of the invention.

Referring to FIGS. 6 and 7, a coupling capacitance and a grounding capacitance for each resonator is formed by each capacitor block 30*a*, 30*b*, 30*c*. Specifically, each of the three rectangular parallelopiped dielectric blocks 30*a*, 30*b*, 30*c* has a through-hole 50*a*, 50*b*, 50*c* coated with a conductive material, and conductive layers 35*a*, 35*b*, 35*c* (hatched in the drawing) on top and bottom surfaces. This structure can provide a pair of capacitances (i.e., coupling capacitance $C_1$ and grounding capacitance $C_A$) which are mutually connected in each of the resonators. Accordingly, an output terminal of each of the resonators 10*a*, 10*b*, 10*c* is connected through connector leads $S_1$, $S_2$, $S_3$ with the conductive layers 35*a*, 35*b*, 35*c* of the capacitor units 30*a*, 30*b*, 30*c*. A coupling inductance $L_{12}$ is connected between the conductive films of the first and second through-holes 50*a* and 50*b* of the capacitor unit blocks 30*a*, 30*b*, and a coupling inductance $L_{23}$ is connected between the conductive films of the second and third through-holes 50*b* and 50*c* of the capacitor unit blocks 30*b*, 30*c*, respectively. Terminal leads $S_A$ and $S_C$ are fitted to the through-holes 50*a*, 50*c*, respectively, to provide a desired band pass filter construction.

Referring to FIG. 7 showing an example of the capacitor block 30 (i.e., any one of blocks 30*a*, 30*b*, 30*c* in FIG. 6), a coupling capacitance $C_1$ is formed between the inner conductive film of the through-hole 50 and the upper conductive layer 35, and a grounding capacitance $C_A$ is formed between the inner conductive film of the through-hole 50 and the bottom conductive layer 38. As illustrated, the coupling capacitance $C_1$ and the grounding capacitance $C_A$ are formed by a single dielectric block of the capacitor unit 30 and, moreover, the two capacitances $C_1$ and $C_A$ are connected with each other without using a lead wire. In the illustrated embodiment, the capacitor unit block 30 is stepped or offset by preferably selecting a length $l_1$ of the top surface 35 and a length $l_2$ of the bottom surface 38 to provide a small value of the coupling capacitance $C_1$ without effecting the grounding capacitance $C_A$. The lengths $l_1$ and $l_2$ can be selected depending upon the values of the coupling capacitance $C_1$ and the grounding capacitance $C_A$.

Figure 7A:
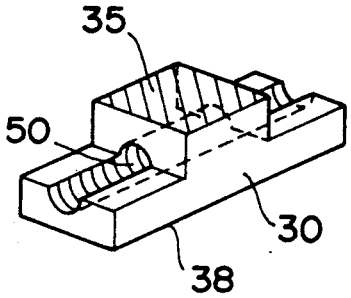

If necessary, the capacitor unit 30 is provided with two offset portions at the opposite ends of the hole 50 so that the top conductive layer 35 is positioned at the middle of the hole 50 as illustrated in FIG. 7A.

Figure 8:
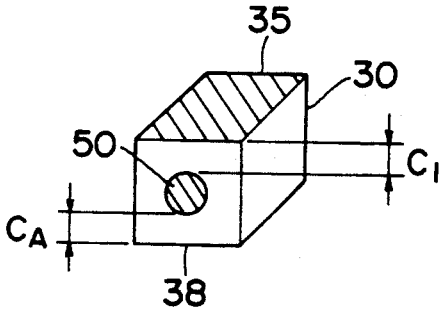

Referring to FIG. 8, a dielectric block of a capacitor unit 30 is shown which is applicable when the value of coupling capacitance is equal to the value of grounding capacitance. The block of the capacitor unit 30 in this embodiment of FIG. 8 has a construction that the length $l_1$ is equal to the length $l_2$ ($l_1=l_2$). In this embodiment, smaller capacitance can be obtained by reducing the area of the conductive film of at least one surface of the top and bottom surfaces (35, 38) of the dielectric block of the capacitor unit 30.

Figure 9:
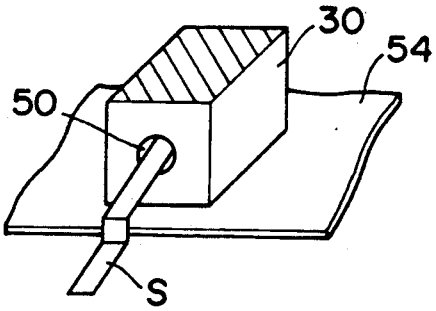
FIG. 9 is a perspective view of the dielectric block shown in FIG. 8 with an input/output terminal disposed therein.

FIG. 9 shows an embodiment in which the dielectric capacitor block shown in FIG. 8 is mounted on a substrate 54 of a ground potential and a lead wire S is inserted into the through-hole 50 so that a pair of capacitances ($C_1$ and $C_A$) are provided. This structure provides a desired filter with a suitable mechanical strength.

Figure 10:
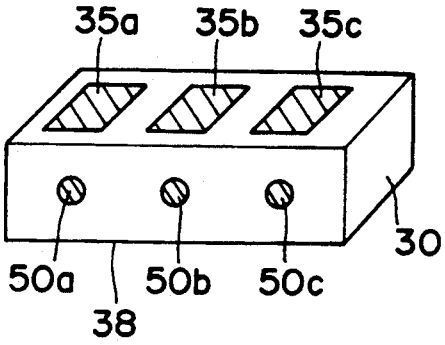
FIG. 10 is a perspective view of a dielectric block having a plurality of pairs of capacitors.

FIG. 10 shows a further modification of the block for the capacitor unit 30, in which a single dielectric rectangular parallelopiped block has three through-holes 50*a*, 50*b*, 50*c* each of which has an associated conductive layer 35*a*, 35*b*, 35*c* on the top surface of the block and a conductive layer 38 on the bottom surface. Thus, three pairs of capacitances are obtained by a single dielectric block.

Figure 11:
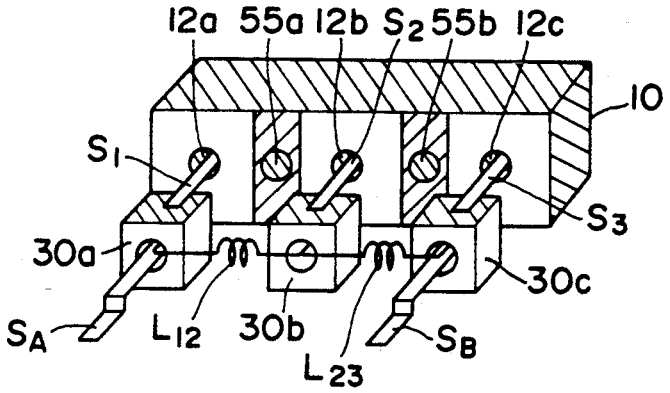
FIG. 11 is a perspective view of a dielectric filter according to a further embodiment of the invention.

FIG. 11 shows another modification, in which a resonator block 10 has three resonator holes 12*a*, 12*b*, 12*c* and two coupling prevention holes 55*a*, 55*b*. The resonator holes 12*a*–12*c* and the coupling prevention holes 55*a*, 55*b* are plated with a conductive material. Three capacitor blocks 30*a*, 30*b*, 30*c* are connected to the resonators of the resonator block 10 through lead wires $S_1$, $S_2$, $S_3$. Other features are similar to those of the embodiment of FIG. 6.

As described above, both the coupling capacitance and the grounding capacitance are formed by a single dielectric block without using additional lead wires.

Figure 12:
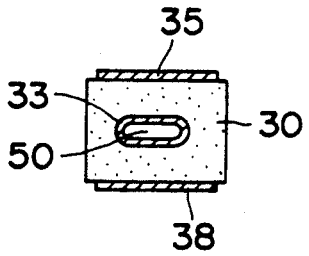
FIG. 12, 13 and 14 are sectional views of a capacitor unit according to other embodiments of the invention.

FIGS. 12–17 show modified structures of a capacitor unit 30 comprised of a dielectric block. In the embodiment of FIG. 12, the through-hole 50 is elliptical in cross section. The through-hole 50 is plated with a conductive material to form a middle electrode as similar as the previous embodiments. The elliptical through-hole 50 provides a large area which confronts the top and bottom electrodes 35, 38, respectively, so that a larger capacitance is obtained.

Figure 13:
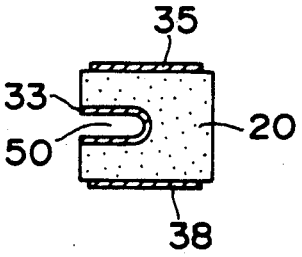

FIG. 13 shows a further modification in which the middle electrode 33 is formed in the shape of a groove 50. By varying the depth of the groove 50, the confronting area of the electodes can be changed to thereby adjust the value of the capacitance.

Figure 14:
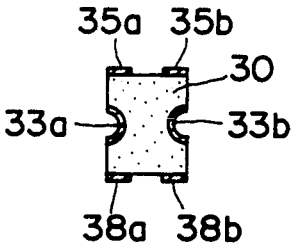
Figure 15:
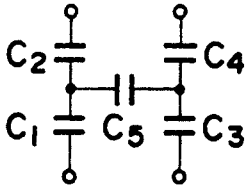
FIG. 15 is an equivalent circuit diagram of the capacitor unit shown in FIG. 14, FIGS. 16 and 17 are sectional views of a capacitor unit according to further embodiments of the invention.

In FIGS. 14 and 15 showing another modification, a bridge-type capacitor circuit and a coupling capacitor are formed on a single dielectric block 30. In the capacitor circuit, two electrodes 35*a*, 35*b* are formed on the top surface and, similarly, two electrodes 38*a*, 38*b* are formed on the bottom surface. Middle electrodes 33*a*, 33*b* of a semi-circle shape are formed on the opposite sides between the top and bottom surface. In this structure, capacitors $C_1$ and $C_2$ are formed between the middle electrodes 33*a*, 38*a*, 35*a* respectively, and, similarly, capacitors $C_3$ and $C_4$ are formed between the middle electrode 33*b* and the bottom and top electrodes 38*b*, 35*b*, respectively. Further, a capacitor $C_5$ is formed between the middle electrodes 33*a* and 33*b*. The capacitor $C_5$ functions and operates as a coupling capacitor which couples the two pairs of capacitors formed through the middle electrtodes 33*a*, 33*b*.

Figure 16:
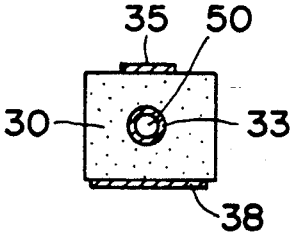
Figure 17:
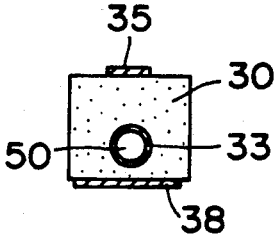
Figure 18:
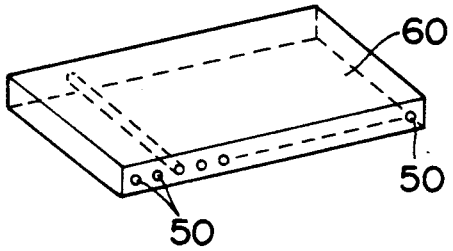
FIGS. 18 through 22 show the steps for producing the capacitor block shown in FIG. 7.

In FIG. 16 showing another modification, the area of the top electrode 35 is smaller than that of the bottom electrode 38 so that the capacitance C2 (FIG. 15) formed between the middle electrode 33 and the top electrode 35 is smaller than the capacitance $C_1$ formed between the middle electrode 33 and the bottom electrode 38. In this case the middle electrode 33 formed on an inner surface of the through-hole 50 is located at a middle portion on a line extending between the top and bottom electrodes, but in order to make the capacitor $C_1$ become much larger than the capacitor $C_2$, the middle electrode 33 can be located closer to the the bottom electrode 38 as illustrated in FIG. 17.

FIGS. 18 to 22 show the steps for preparing the capacitor unit illustrated in FIG. 7. First, a dielectric plate 60 having a plurality of parallel through-holes 50 is prepared. The multi-apertured dielectric plate 60 can be formed in a known manner.

Figure 19:
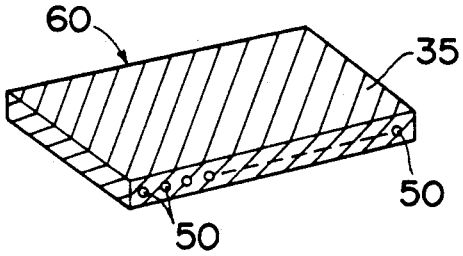

The prepared dielectric plate 60 is then plated entirely with a conductive material on its all surfaces and on the inner surface of the through-holes 50 by suitable methods such as coating, printing, plating, etc. to form a conductive film 35 as hatched in FIG. 19.

Figure 20:
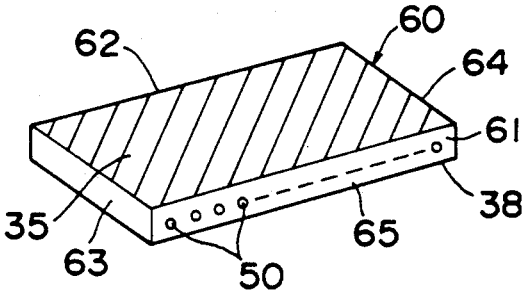

The entirely plated dielectric plate 60 is then subjected to a step of removing the plated film from the four non-hatched sides 61, 62, 63, 64 as shown in FIG. 20 by using a mechanical cutting or grinding method.

Alternatively, a printing technique can be applied to print the top and bottom surfaces only, with the four sides 61–64 remained unprinted.

Figure 21:
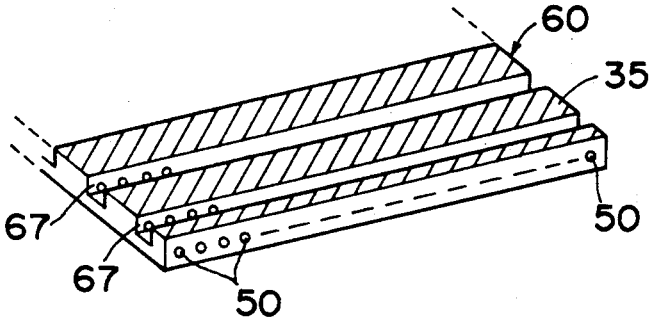

After the dielectric plate 60 is covered or entirely plated with a conductive material with the exception of the four side surfaces 61–64, a plurality of grooves 67 with a depth of a half of the thickness of the plate 60 are formed at a right angle relative to the through-hole 50, as illustrated in FIG. 21.

Figure 22:
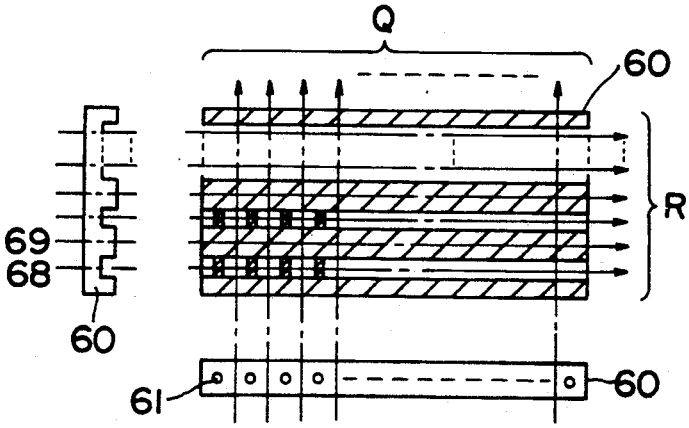

The thus grooved dielectric plate 60 is cut in the longitudinal direction of the through-holes 50 at a middle portion between the adjacent through-holes 50 as shown by arrows Q in FIG. 22, and also cut in the longitudinal direction of the grooves 67 at a middle portion of the bottom of the grooves 67 and at a middle portion of the non-grooved portions as shown by arrows R.

Thus, a mass fabrication of the capacitor unit shown in FIG. 7 can be obtained. If the groove-forming step is omitted, a capacitor unit as that of FIG. 8 can be formed.

What is claimed is:

1. A ceramic filter comprising:

a dielectric resonator block having a plurality of resonators in an integral form, coupling means for coupling said resonators, a dielectric capacitor block having a plurality of holes, first electrode means having a surface electrode disposed on surface of said dielectric capacitor block and second electrode means on an inner surface of said holes of said capacitor block, wherein said dielectric capacitor block comprises:

a first capacitor portion for obtaining a coupling capacitance in combination with one of said resonators, a second capacitor portion, connected in parallel with said coupling means, for serving as a reactance element, and common electrode means for said first capacitor portion and said second capacitor portion, said common electrode means being connected with external connectors.

2. The ceramic filter according to claim 1, wherein said plurality of holes includes a first hole and a second hole, and said surface electrode is adjacent to said first hole, said first hole being connected with said external connector, and said second hole and said surface electrode being connected with said resonators.

3. The ceramic filter according to claim 2, wherein said dielectric capacitor block has a projection at a bottom thereof and a conductive layer on an extended end surface of said projection.

4. The ceramic filter according to claim 2, wherein said surface electrode has a top electrode plated on an upper surface of said dielectric capacitor block and a bottom electrode plated on a bottom surface of said dielectric capacitor block, said top electrode being different in size from said bottom electrode.

5. The ceramic filter according to claim 2, wherein each of said holes of said dielectric capacitor block is elliptical in cross section.

6. The ceramic filter accoding to claim 2, wherein each of said holes of said dielectric capacitor block is groove shaped with its one longitudinal side being opened.

* * * * *